United States Patent [19]

Davies et al.

[11] 4,441,070

[45] Apr. 3, 1984

[54] VOLTAGE REGULATOR CIRCUIT WITH SUPPLY VOLTAGE RIPPLE REJECTION TO TRANSIENT SPIKES

[75] Inventors: Robert B. Davies, Tempe; Eric D. Joseph, Mesa, both of Ariz.

[73] Assignee: Motorola, Inc., Schaumburg, Ill.

[21] Appl. No.: 352,902

[22] Filed: Feb. 26, 1982

[51] Int. Cl.[3] ..... G05F 1/56

[52] U.S. Cl. ..... 323/268; 323/280; 323/303

[58] Field of Search ..... 323/268, 273, 281, 311–316, 323/280, 303; 330/288

[56] References Cited

U.S. PATENT DOCUMENTS

| | | | |
|---|---|---|---|
| 3,509,449 | 4/1970 | Andren | 323/280 |
| 3,735,240 | 5/1973 | Davis et al. | 323/280 |
| 3,939,399 | 2/1976 | Funatsu et al. | 323/303 |
| 3,946,303 | 3/1976 | Streit et al. | 323/280 |
| 4,341,990 | 7/1982 | Davis | 323/303 |

FOREIGN PATENT DOCUMENTS

| | | | |
|---|---|---|---|
| 55-43643 | 3/1980 | Japan | 323/281 |

OTHER PUBLICATIONS

Electronic Engineering, vol. 49, No. 595, pp. 20, 21, Aug. 1977.

*Primary Examiner*—William H. Beha, Jr.
*Attorney, Agent, or Firm*—Michael D. Bingham

[57] ABSTRACT

A solid state circuit for providing a DC regulated output voltage at an output thereof wherein the circuit exhibits excellent ripple rejection performance to maintain the regulated output voltage constant with perturbations in the supply voltage applied to the circuit. The circuit includes a precision current source for providing output currents to a load circuit which is connected between the current source and ground reference. A bias reference potential is applied to the load circuit which has an output connected to the output of the circuit and a feedback loop for causing the DC regulated voltage to be proportional to the bias reference potential. A frequency compensation circuit is included that is coupled across outputs of the current source which enhances the ripple rejection performance of the circuit to higher frequency component transients of such perturbations in the supply voltage.

21 Claims, 2 Drawing Figures

VOLTAGE REGULATOR CIRCUIT WITH SUPPLY VOLTAGE RIPPLE REJECTION TO TRANSIENT SPIKES

BACKGROUND OF THE INVENTION

This invention relates to solid state regulated DC voltage supply circuits. More particularly, this invention relates to a solid state regulator circuit for providing a substantially constant DC output voltage which is capable of rejecting ripples in the magnitude of the supply voltage applied thereto.

The prior art is replete with various voltage regulator circuits for supplying substantially constant output DC regulated voltages. There are as many techniques for regulating the voltage output of these regulator circuits as there are applications for such regulators. In a system in which switching of currents occurs there is generally generated voltage transient spikes that can appear on the voltage supply line. If these voltage transients are of sufficient magnitude, the system operation may be adversely affected whereby the performance is deleteriously affected.

For example, in a magnetic bubble integrated sense amplifier system, the positive power supply of the system is required to provide currents of magnitude up to one ampere peak to the x and y field coils of the bubble memory as is generally known. These field currents are switched at a field rotation frequency of between 50 and 200 KHz. This switching causes voltage transient spikes to appear on the supply line to the sense amplifier system. Because the magnitudes of the transient spikes are large in comparison to the magnitude of a magnetic bubble signal, the internal supply voltage rail of the bubble sense amplifier system must have a very high voltage supply rejection performance so that the transient spikes on the supply line do not prevent detection of the bubble present signal.

Additionally, the system must provide ripple rejection at frequencies up to 10 MHz because of the high frequency components present in the transient spikes. Moreover, the rejection performance of the system must be provided with as simple of a circuit as possible as the sense amplifier system is manufactured in integrated circuit form to thereby reduce requirements for die size and to reduce system costs while enhancing circuit yield factors.

Thus, there is a need for a voltage regulator circuit for rejecting ripples in an unregulated power supply voltage supplied thereto to provide a substantially constant, regulated DC output voltage. The circuit must operate with perturbations of the power supply voltage having frequency components up to frequencies of 10 MHz.

REFERENCE TO RELATED APPLICATIONS

The subject matter of the subject invention is related to co-pending U.S. Patent applications, Ser. Nos. 352,901, and 352,906 now U.S. Pat. No. 4,413,226, which are assigned to the assignee of the subject invention.

SUMMARY OF THE INVENTION

Accordingly, it is an object of the present invention to provide an improved voltage regulator circuit for supplying a DC regulated output voltage.

It is another object of the present invention to provide a regulator circuit for providing a DC regulated output voltage having excellent ripple rejection to variations in the power supply voltage.

An additional object is to provide an integrated voltage regulator circuit for maintaining a constant DC regulated output voltage by rejecting variations in the supply voltage due to voltage transient spikes occuring on the supply line.

Still another object of the present invention is to provide an integrated voltage regulator circuit suitable to be utilized in a bubble memory sense amplifier having excellent power supply ripple rejection.

In accordance with the above and other objects, there is provided a voltage regulator for producing a DC regulated voltage at an output thereof. The voltage regulator rejects ripples in the supply voltage supplied thereto such that the magnitude of the regulated voltage does not vary with perturbations in the supply voltage. The voltage regulator circuit comprises a current source for producing first and second currents at first and second outputs respectively, a ground reference load circuit coupled with the current source, and a compensation circuit coupled between the two outputs of the current source. The load circuit is responsive to the output currents from the current source and to a bias reference potential supplied thereto for producing the DC regulated output voltage. The compensation circuit enhances the ripple rejection performance of the regulator circuit by nullifying frequency dependent characteristics of the current source as well as any frequency dependent characteristics associated with the bias reference potential in conjunction with the load circuit.

DETAILED DESCRIPTION OF THE INVENTION

Figure 1:
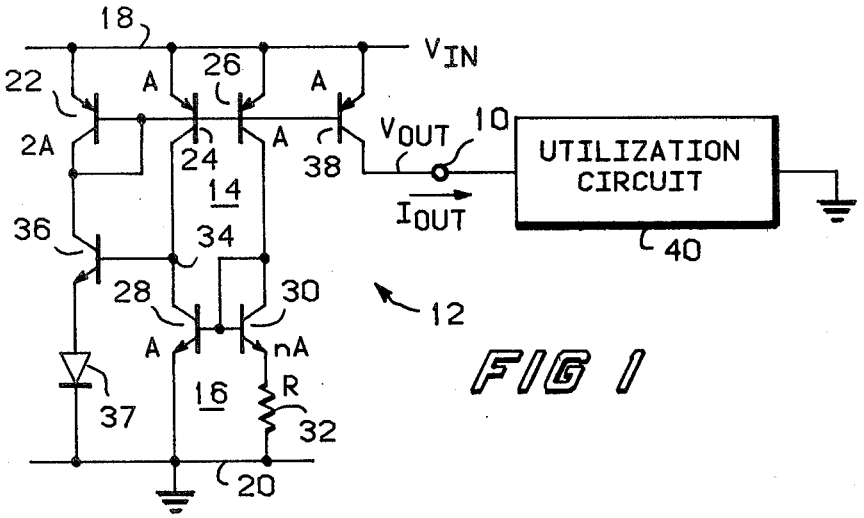
FIG. 1 is a schematic diagram illustrating a precision current source having supply voltage ripple rejection characteristics.

Turning to FIG. 1, there is shown a simplified schematic of a low voltage precision current source, suitable for fabrication as an integrated circuit, which is utilized to provide a precision regulated DC voltage at output terminal 10 in accordance with the preferred embodiment of the present invention. Current source 12 comprises interconnected complimentary current mirror circuits 14 and 16 as well as feedback means coupled there between for setting the quiescent operating point of the circuit while providing ripple rejection to variations in the power supply voltage $V_{in}$ supplied across conductors 18 and 20.

Current mirror circuit 14 includes PNP transistors 22, 24 and 26 with respective emitters coupled to conductor 18 and respective bases commonly connected to each other. Transistor 22 is connected as a diode and functions in a known manner to force the currents sourced at the collectors of transistors 24 and 26 to be substantially of equal magnitude. Although the emitter areas of transistors 22, 24 and 26 may be equal, the emitter area of transistor 22 is shown as being ratioed with respect to the emitter areas of transistors 24 and 26. In the present case, the emitter area of transistor 22 is illustrated as being equal to twice the area of the emitters of transistors 24 and 26. Hence, transistor 22 will source twice the collector current of either transistor 24 or 26.

Current mirror circuit 16 includes NPN transistors 28 and 30. Transistor 30 is connected as a diode and is shown as having an emitter of area n times the emitter area of transistor 28. The base electrodes of these two transistors are connected to one another with the emitter of transistor 28 being returned to ground reference via conductor 20. The emitter of transistor 30 is returned to conductor 20 through resistor 32 which as shown has a resistance value equal to R.

A feedback loop is provided by feedback NPN transistor 36 which has its collector-emitter path coupled between the collector of transistor 22 and power supply conductor 20 via biasing diode 37. The base of transistor 36 is coupled to both current mirrors 14 and 16 at node 34.

In operation, current sourced at the collector of transistor 26 flows through the collector-emitter path of transistor 30. This produces current flow in the collector-emitter path of transistor 28 to sink the current sourced at the collector of transistor 24. Because transistor 28 and 30 are operated at different current densities, a voltage is produced across resistor 32 which is substantially equal to the difference in the base-to-emitter voltage developed across these two transistors and is referred to as $\Delta V_{be}$. Thus, the collector-emitter current of transistor 30 has a value which can be shown to be substantially equal to:

$$(kT/qR)(\ln)(n) \quad (1)$$

where:

k is Boltzmann's constant

T is the absolute temperature q is the charge of an electron

Since transistors 24 and 26 are matched (having equal emitter areas and characteristics) the magnitude of the collector currents source therefrom will be substantially equal. However, since transistor 28 sinks only $1/n^{th}$ of the available current sourced from transistor 24, an excess current is available at node 34 which renders feedback transistor 36 conductive. Thus, as transistor 36 is rendered conductive, current is sourced from the collector of transistor 22 via its collector-emitter path. This action increases the current that is sourced from the collectors of transistors 24 and 26 as these two transistors are caused to be rendered more conductive. This regeneration action continues until such time that a quiescent operating point is reached. The quiescent operating point is nominally the state at which the magnitude of the collector currents of transistors 28 and 30 are substantially equal and the $\Delta V_{be}$ between transistors 28 and 30 is substantially equal to the voltage drop caused by said current in resistor 32.

PNP output transistor 38 has its emitter and base coupled in parallel with the emitter and base of respective current sourcing transistors 24 and 26. The collector of transistor 38 is coupled at output terminal 10 to a utilization circuit 40 which is returned to ground potential. The emitter area of transistor 38 may be made any ratio of the emitter areas of respective transistors 24 and 26. However, as illustrated, transistor 38 is matched with transistors 24 and 26. Hence, the collector current sourced from transistor 38 will be substantially equal in magnitude to the collector currents of transistors 24 and 26. Therefore, the output current, $I_{out}$, is substantially equal to the collector current of transistor 26 which itself is a function of the current $\Delta V_{be}/R$. At the quiescent operating point $I_{out}$ is substantially equal to:

$$(kT/qR)(\ln)(n) \quad (2)$$

and a regulated DC output voltage $V_{out}$ is provided at output terminal 10, across utilization circuit 40.

The above described circuit provides ripple rejection to perturbations in the magnitude of $V_{in}$ as will hereinafter be described. If, for example, the magnitude of the voltage $V_{in}$ should vary in a direction to cause the upper current source transistors 22, 24 and 26 to attempt to become more conductive, transistor 30 will initially become more conductive to sink the increased collector current from transistor 26. This action increases the voltage drop across resistor 32 which in turn raises the voltage level appearing at the base of transistor 28. Transistor 28 will thus become more conductive to sink more than the additional current sourced from transistor 24. As transistor 28 is rendered more conductive, the voltage level appearing at the base of transistor 36 decreases in magnitude. This causes transistor 36 to become less conductive to, in-turn, reduce the collector currents sourced by transistors 22, 24, and 26. Under general operating conditions, the feedback loop response time is fast enough to respond to variations in $V_{in}$ to maintain the output current sourced to output node 10 constant as the voltage $V_{in}$ varies within a predetermined range. Likewise, if $V_{in}$ varies in an opposite direction, transistor 36 is rendered more conductive, to cause the PNP current source transistors to conduct harder thereby maintaining $I_{out}$ substantially constant.

A problem may arise if current source 10 is operated in a noisy environment where noise transient spikes may occur having relatively high frequencies. At higher frequencies errors may occur at the output of the circuit which reduces the circuit's ripple rejection characteristics. The main source of these errors is due to the phase shift associated through the feedback loop comprising transistor 36. This phase shift prevents instantaneous tracking of variations in the magnitude of the supply voltage $V_{in}$.

Figure 2:
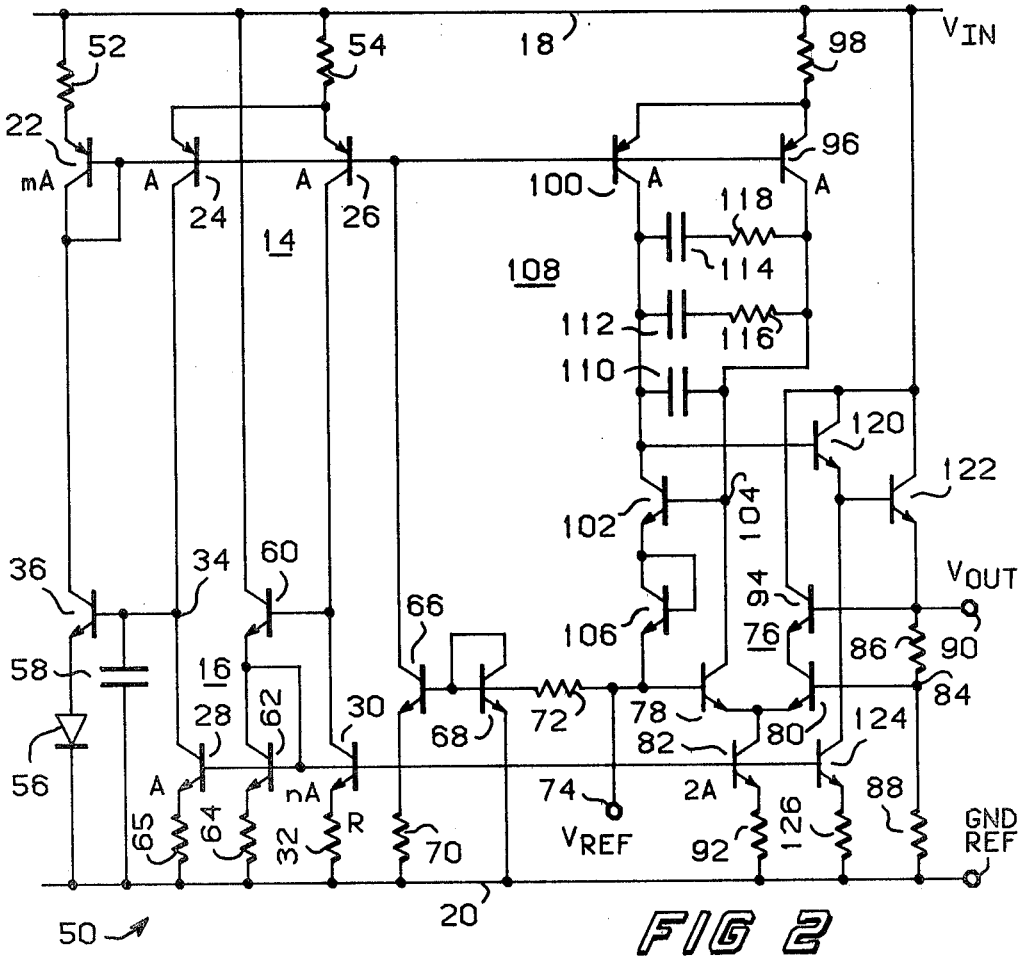
FIG. 2 is a schematic diagram illustrating the voltage regulator circuit of the present invention.

Turning now to FIG. 2 there is shown voltage regulator circuit 50 which incorporates the features of current source 12 described above to produce a DC regulated output voltage $V_{out}$ at an output thereof. It is to be understood that components of voltage regulator circuit 50 corresponding to like components of current source 12 are referenced by the same reference numerals.

Regulator circuit 50 provides voltage supply ripple rejection to voltage transients appearing on the voltage supply line 18 which can have very high frequency components. In fact, regulator circuit 50 provides very good voltage supply ripple rejection to transient spikes having frequency components at ten megahertz and higher.

As illustrated, emitter degeneration resistors 52 and 54 are placed between the emitters of transistors 22, 24 and 26 and power supply conductor 18 of current mirror circuit 14 which, among other things, provide enhanced matching between these transistors. Transistor 22 is illustrated as having an emitter area m times the emitter areas of transistors 24 and 26, where m may be any desired number. Diode 56, which corresponds to diode 37, is placed between the emitter of transistor 36 and conductor 20 for biasing the emitter of this transistor at a $V_{be}$ above ground reference. Capacitor 58, which is coupled between the base of transistor 36 and conductor 20, provides compensation for the high gain feedback loop comprising transistor 36 to prevent oscillations that otherwise may occur. Current mirror circuit 16 includes NPN transistor 60 which acts as a well known "beta current" eliminator to reduce current errors in the mirror circuit due to the base currents of transistors 28, 30, 62, 82, and 124. Diode connected NPN transistor 62, having its emitter coupled via resistor 64 to conductor 20 and its collector connected to the emitter of transistor 60, forces a known current to be sourced through transistor 60. Transistors 30 and 60 form the diode element of current mirror 16 as is understood. In addition, transistor 28 includes a resistor 65 connected between the emitter of this transistor and conductor 20.

Because voltage regulator circuit 50 is suitable to be manufactured in monolithic integrated circuit form, a start-up circuit is provided which comprises transistors 66 and 68, and resistors 70 and 72. As bias reference voltage, $V_{ref}$, is supplied at terminal 74 current flows through resistor 72 and diode connected transistor 68. Transistor 66 and 68 are connected as a current mirror whereby current is therefore caused to flow through the collector-emitter path of transistor 66 and resistor 70 as $V_{in}$ is supplied to the circuit. Resistor 70 is of sufficient value to limit the collector current through transistor 66 to a small known value. However, this collector current is sufficient to render current source transistors 22, 24 and 28 conductive as the collector current of transistor 66 is sourced from these transistors. Thus, transistors 22, 24, and 28 are rendered conductive to initiate the regenerative feedback action of transistor 36, as previously described, to latch the regulator circuit into a nominal quiescent operating point wherein the collector currents of transistors 28 and 30 are made substantially equal to each other.

A utilization or load circuit that is returned to ground reference potential is provided at the output of the current source which includes a comparator amplifier. The comparator amplifier has an input stage and an output stage. Differential gain stage 76 comprises the input stage of the comparator amplifier and includes NPN transistors 78 and 80 the emitters of which are connected in common to the collector of current source transistor 82. The base of transistor 78, which serves as one input of the differential amplifier, is coupled to terminal 74 and is biased at $V_{ref}$. The base of transistor 80 is coupled to node 84 between the interconnection of series connected resistors 86 and 88. These two resistors are connected between output terminal 90 and conductor 20. Current source transistor 82 supplies the tail current through amplifier 76. The emitter of transistor 82 is coupled via resistor 92 to conductor 20 with the base being connected to the bases of transistors 28 and 30 of current mirror circuit 16 such that the base-emitter path of transistor 82 is coupled in parallel with these latter devices. NPN transistor 94 is connected in cascode between the collector of transistor 80 and conductor 18 and has its base coupled to output terminal 90. As is understood, cascoded transistor 94 is provided to reduce Early voltage errors that may be caused by any difference voltage occurring between the collectors of transistors 78 and 80. Transistor 94 establishes the voltage at the collector of transistor 80 to reduce such errors. Therefore, the operation of differential amplifier 76 is then less likely to effect the magnitude of $V_{out}$ due to temperature changes of the integrated chip as well as input voltage supply variations.

The collector of transistor 78 of amplifier 76 is connected to the collector of PNP current source transistor 96 at an output of current source 14. The base-emitter path of transistor 96 is coupled in parallel to the base-emitter paths of transistors 24 and 26 via emitter degeneration resistor 98. Similarly, PNP transistor 100 has its base-emitter path coupled in parallel to transistor 96 with the collector of thereof being coupled at another output of current source 14 to the collector of NPN transistor 102. Transistor 102 and diode connected NPN transistor 106 form the output stage of the comparator amplifier. The base of transistor 102 is connected to the collector of transistor 78 at node 104. Diode connected transistor 106 is coupled between the emitter of transistor 102 and terminal 74. Transistors 96, 100, 102, and 106 and resistor 98 form a gain stage across which pole splitting frequency compensation circuit 108 is provided. Compensation circuit 108 comprises capacitor 110 coupled between the collector of transistor 102 and node 104, as well as capacitors 112, and 114 that are coupled respectively in series with resistors 116 and 118 in parallel to capacitor 110.

A Darlington amplifier follower stage comprising NPN transistors 120 and 122 as well as NPN transistor 124 is connected between the collector of transistor 102 and voltage supply $V_{in}$ to output terminal 90. Transistor 124 which has its collector-emitter path coupled between emitter and base interconnections of transistors 120 and 122 and conductor 20 via resistor 126 and its base connected in common with the base of transistor 82 to current mirror circuit 16 is provided to increase the operating speed of the Darlington follower stage as is understood.

The output voltage, $V_{out}$, appearing at output terminal 90 is made proportional to the voltage $V_{ref}$ via the resistive divider comprising resistors 86 and 88. Thus, in response to an output signal from the Darlington amplifier, the voltage appearing at node 84 is forced to a voltage level that causes the collector currents of transistor 78 and 80 to be substantially equal in magnitude by the feedback action through resistors 86 and 88. Moreover, the respective collector currents of these two transistors will be ideally one-half the value of the tail current flowing through transistor 82. This value of the tail current is set by current mirror 16.

Rejection to lower frequency variations in the magnitude of $V_{in}$ is provided as aforedescribed with reference to FIG. 1. Hence, if $V_{in}$ should increase in level, the initial increase in current sourced from current mirror 14 increases the current flow in current mirror 16. This causes the tail current through transistor 82 to increase whereby any increase in current source by transistors 96 and 100 is sourced through transistors 78 and 80. Hence, the quiescent operating level at the base of transistor 120, the input of the Darlington follower stage, remains substantially the same which inhibits any changes in the level of the output DC regulated voltage $V_{out}$.

The frequency response of regulator circuit 50 is increased over the circuit described with respect to FIG. 1 by the addition of the gain stage comprising transistors 96, 100, 102, and 106, resistor 98 and compensation circuit 108.

The gain stage and the compensation circuit introduce frequency domain zeros and poles which can be tailored to offset the poles generated by the remainder of the circuit comprising the voltage regulator whereby the response characteristics of the ratio $V_{out}/V_{in}$ can be tailored to provide enhanced ripple rejection performance of the regulator to the higher frequency components of the transient input voltage spikes.

Additionally, variations in the impedance of the voltage source $V_{ref}$ due to its frequency characteristics can be tailored by feedback through transistors 102, 106 and associated circuitry to maintain the impedance presented to differential amplifier 76 substantially constant with frequency. This improves the operation of the differential amplifier to enhance its performance at higher frequencies.

A voltage regulator circuit fabricated in accordance with the above disclosure provided ripple rejection greater than −30 db at frequencies up to 10 MHz while exhibiting stable operation. The unity gain cross over point occurs at approximately 75 MHz with 68° of phase margin. The circuit was fabricated using the following component values:

| Component and Transistor Ratios | Value |
|---|---|
| Capacitor 58 | 40 pF |
| Capacitor 110 | 2.5 pF |
| Capacitor 112 | 5.0 pF |
| Capacitor 114 | 20.0 pF |
| Resistor 32 | 1360 ohms |
| Resistors 52,54,98,92 | 500 ohms |
| Resistor 64,65 | 1000 ohms |
| Resistor 70 | 20,000 ohms |
| Resistor 72 | 50,000 ohms |
| Resistor 86 | 6970 ohms |
| Resistor 88 | 3030 ohms |
| Resistor 116 | 1500 ohms |
| Resistor 118 | 4000 ohms |
| Resistor 126 | 1000 ohms |
| n | 4 |
| m | 2 |

We claim:

1. A voltage regulator for providing a substantially constant voltage supply at an output thereof, comprising:

first and second power supply conductors across which a power supply voltage is connected;

current source means coupled between said first and second power supply conductors for providing first and second currents at respective outputs the magnitudes of each being substantially independent to power supply ripples;

comparator amplifier means including a differential stage having first and second inputs and an output, and a gain stage coupled between said output of said differential stage and said first input thereof and having an output, said outputs of said differential stage and said gain stage being coupled to respective ones of said outputs of said current source means, said first input of said differential stage receiving a reference potential;

amplifier means coupled with said output of said gain stage and said second input of said differential stage to the output of the regulator; and compensation means coupled between said respective outputs of said differential stage and said gain stage for introducing frequency domain zeros and poles into the transfer characteristics of the regulator to provide ripple rejection performance of the regulator.

2. The voltage regulator of claim 1 wherein said compensation means includes:

first capacitive means coupled between said outputs of said differential and gain stages; and first and second capacitive circuit means coupled in parallel with respect to each other between said outputs of said differential and gain stages.

3. The voltage regulator of claim 2 wherein said amplifier means includes:

a Darlington amplifier coupled between said output of said gain stage and the output of the regulator;

resistive divider means including first and second resistors serially connected between the output of the regulator and said second power supply conductor; and circuit means connecting said second input of said differential stage to the interconnection of said first and second serially connected resistors.

4. A voltage regulator circuit for providing a DC regulated voltage at an output thereof that rejects ripples occurring in the supply voltage applied thereto such that the regulated voltage does not substantially vary in magnitude with variations in the supply voltage, comprising:

current source means adapted to receive the supply voltage for providing output currents having substantially constant magnitudes, said current source means including first and second complementary current mirror circuits, said first current mirror circuit sourcing currents to said second current mirror circuit, feedback circuit means coupled between said first and second complementary current mirror circuits for maintaining said first and second current mirror circuits at a quiescent operating point substantially independent of variations in the supply voltage, and output circuit means coupled with said first current mirror circuit for providing said output currents at first and second outputs of said current source means;

comparator amplifier means having first and second inputs and an output, said first input being adapted to receive a reference potential thereat, said comparator amplifier means including an input stage and an output stage, said input stage having first and second inputs being said first and second inputs of said comparator amplifier means and an output, said output stage being coupled between said first input of said input stage and said output thereof and having an output coupled to said output of said comparator amplifier means, said input and output stages receiving said output currents provided from said current source;

amplifier means coupled between said output of said comparator amplifier means and said output of the regulator circuit for providing an output signal;

circuit means coupled between said output of the regulator circuit and said second input of said comparator amplifier means which is responsive to said output signal from said amplifier means for producing the DC regulated output voltage and maintaining the voltage level appearing at said second input to said comparator means substantially equal to said reference potential; and compensation circuit means coupled between said input and output of said output stage which, in conjunction with said output stage, provides frequency compensation for the voltage regulator circuit to enhance the supply voltage ripple rejection performance of the regulator circuit.

5. The voltage regulator circuit of claim 1 wherein said feedback circuit means includes a first transistor of a first conductivity type having an emitter, a collector and a base, said emitter being coupled to a first supply conductor at which a ground reference potential is supplied, said collector being coupled to said first current mirror circuit, said base being connected at a first circuit node to said first and second current mirror circuits.

6. The voltage regulator circuit of claim 5 wherein said first current mirror circuit includes:

a second transistor of a second conductivity type having an emitter, a collector and a base, said emitter being coupled to a second supply conductor at which is provided the supply voltage, said collector being coupled with said base to said collector of said first transistor; and third and fourth transistors of said second conductivity type each having an emitter, a collector and a base, said emitters being coupled in common to said second supply conductor, said bases being coupled in common to said base of said second transistor, said collector of said third transistor being coupled to said first circuit node, said collector of said fourth transistor being coupled to said second current mirror circuit at a second circuit node.

7. The voltage regulator circuit of claim 6 wherein said second current mirror circuit includes:

a fifth transistor of said first conductivity type having an emitter, a collector and a base, said emitter being coupled to said first supply conductor, said collector being coupled to said first circuit node;

diode means coupled between said second circuit node and said first supply conductor, said diode means coupling said base of said fifth transistor to said second circuit node; and a first resistor coupled between said diode means and said first supply conductor.

8. The voltage regulator circuit of claim 7 wherein said diode means includes:

a sixth transistor of said first conductivity type having an emitter, a collector and a base, said base being coupled to said base of said fifth transistor, said collector being coupled to said second circuit node, said emitter being coupled to said first resistor;

a seventh transistor of said first conductivity type having an emitter, a collector and a base, said collector being coupled to said second supply conductor, said base being coupled to said second circuit node, said emitter being coupled to said base of said sixth transistor;

a second resistor having first and second leads, said first lead being coupled to said first supply conductor; and a diode coupled between said base of said sixth transistor and said second lead of said second resistor.

9. The voltage regulator circuit of claim 8 wherein said diode includes a diode-connected transistor of said first conductivity type having an emitter coupled to said second lead of said second resistor, a base coupled to said base of said fifth transistor and a collector coupled both to said base thereof and to said emitter of said seventh transistor.

10. The voltage regulator circuit of claim 6 wherein said output circuit means includes eighth and ninth transistors of said second conductivity type each having an emitter, a collector and a base, said emitters being commonly coupled to said second supply conductor, said bases being commonly coupled to said base of said fourth transistor, said collectors being said first and second outputs respectively of said current source means.

11. The voltage regulator circuit of 7 wherein said comparator amplifier means includes:

a differential amplifier comprising said input stage, said differential amplifier including sixth and seventh transistors of said first conductivity each having an emitter, a collector and a base, said base of said sixth transistor being said first input of said comparator amplifier means, said base of said seventh transistor being said second input of said comparator amplifier means, said collector of said sixth transistor being coupled both to an input of said output stage and to said second output of said current source means, said collector of said seventh transistor being coupled to said second supply conductor; and a current source transistor of said first conductivity type having an emitter, a collector and a base, said emitter being coupled to said first supply conductor, said collector being coupled to said emitters of said sixth and seventh transistors, said base being coupled to said base of said fifth transistor.

12. The voltage regulator of claim 11 wherein said output stage includes: an eighth transistor of said first conductivity type having an emitter, a base and a collector, said collector being coupled to said first output of said current source means, said base being coupled to said second output of said current source means, said emitter being coupled to said first input of said comparator.

13. The voltage regulator circuit of claim 12 wherein said output stage includes a diode is formed by a ninth transistor of said first conductivity type having an emitter, a collector and a base, said emitter being connected to said first input of said comparator amplifier means, said collector being connected with said base to said emitter of said eighth transistor.

14. The voltage regulator circuit of claim 12 wherein said circuit means includes a resistive divider having first and second series connected resistors coupled between said output of the voltage regulator circuit and said first supply conductor, said second input of said comparator amplifier being coupled to the interconnection between said series connected resistors.

15. A voltage regulator circuit for providing a DC regulated voltage at an output thereof, the voltage regulator circuit substantially rejecting perturbations of the supply voltage applied thereto, comprising:

current source means for producing first and second currents at first and second outputs, said current source means comprised of a first current mirror circuit including a plurality of current sourcing transistors of a first conductivity type, a second current mirror circuit including a plurality of current sinking transistors of a second conductivity type, and a feedback amplifier coupled between said first and second current mirror circuits for providing a feedback loop therebetween which is responsive to instantaneous perturbations of the supply voltage to inhibit changes in said first and second output currents;

load circuit means coupled with said current source means to a first terminal adapted to receive a ground potential, said load circuit means receiving a reference bias potential at an input and said first and second currents for producing the DC regulated voltage at the output of the voltage regulator circuit, said load circuit means being comprised of comparator amplifier means including an input stage and an output stage, said input stage being adapted to receive said reference bias potential and a feedback signal, said output stage being coupled between said input stage and an output of said comparator amplifier means, said input and output stages being responsive to said first and second currents from said current source means, an output amplifier coupled between said output of said comparator amplifier means and the output of the voltage regulator circuit, and circuit means coupled between the output of the voltage regulator circuit and said first terminal and having an output coupled to said input stage which is responsive to an output signal supplied from said output amplifier for producing said feedback signal; and compensation circuit means coupled between said first and second outputs of said current source means for enhancing the supply voltage ripple rejection performance of the voltage regulator circuit by substantially nullifying frequency dependent characteristics of said current source means.

16. The voltage regulator circuit of claim 5 wherein:

said input stage of said comparator amplifier means includes a differential amplifier comprising first and second transistors of said second conductivity type each having an emitter, a collector and a base, said emitters being commonly coupled to a first node, said collector of said first transistor being coupled to an output of said differential amplifier, said collector of said second transistor being coupled to a second terminal at which is supplied the supply voltage, said base of said first transistor being adapted to receive said bias reference potential, said base of said second transistor being coupled to said output of said feedback circuit means, and a third transistor of said second conductivity type having an emitter coupled to said first terminal, a collector coupled to said first node and a base coupled to said second current mirror circuit; and said output stage includes a fourth transistor of said second conductivity type having an emitter, a collector coupled to said output of said comparator amplifier means to said first output of said current source means, a base coupled to said output of said differential amplifier and to said second output of said current source means, said emitter coupled to said base of said first transistor of said differential amplifier.

17. The voltage regulator circuit of claim 16 wherein said feedback circuit includes first and second series connected resistors with said output being connected to the interconnection of said first and second resistors.

18. The voltage regulator circuit of claim 17 wherein said second current mirror circuit includes:

a first current sinking transistor having an emitter, a collector and base, said emitter being coupled to said first terminal, said collector being coupled to a second node, said second node being coupled to said first current mirror circuit, said base being coupled to a third node and to said base of said fourth transistor of said differential amplifier;

diode means coupled between said third node and a fourth node, said third node being coupled to said first current mirror circuit; and a third resistor coupled between said fourth node and said first terminal.

19. The voltage regulator circuit of claim 18 wherein said first current mirror circuit includes:

a first current sourcing transistor having an emitter, a collector and a base, said emitter being coupled to said second terminal, said collector being coupled to said feedback amplifier;

second and third current sourcing transistors each having an emitter, a collector and a base, said emitters being coupled in common to said second terminal, said bases being coupled in common to said base of said first current sourcing transistor, said collector of said second current sourcing transistor being coupled to said second node, said collector of said third current sourcing transistor being coupled to said third node; and a pair of output current sourcing transistors each having an emitter, a collector and a base, said emitters being coupled in common to said second terminal, said bases being coupled in common to said bases of said second and third current sourcing transistors, said collectors being first and second outputs of said current source means respectively.

20. The voltage regulator circuit of claim 19 wherein said feedback amplifier includes a fifth transistor of said second conductivity type having an emitter coupled to said first terminal, a collector coupled to said collector of said first current sourcing transistor, and a base coupled to said second node.

21. The voltage regulator circuit of claim 15 or 20 wherein said compensation circuit means includes:

a first capacitor coupled between said first and second outputs of said current source means;

first capacitive impedance means coupled between said first and second outputs of said current source means; and second capacitive impedance means coupled between said first and second outputs of said current source means.

* * * * *